US005375707A

United States Patent [19]

Richer

[11] Patent Number: 5,375,707

[45] Date of Patent: Dec. 27, 1994

[54] METHOD AND DEVICE FOR STORING A PUZZLE

[76] Inventor: Jacques Richer, 28 Place Mauriac, Repentigny, Quebec, Canada, J6A 5S2

[21] Appl. No.: 210,461

[22] Filed: Mar. 21, 1994

[51] Int. Cl.[5] ..... B65D 85/672; A63F 9/00

[52] U.S. Cl. ..... 206/315.1; 206/410; 206/412

[58] Field of Search ..... 206/315.1, 389, 398, 206/407, 410, 412; 242/68

[56] References Cited

U.S. PATENT DOCUMENTS

| | | | |
|---|---|---|---|
| 1,543,283 | 6/1925 | Falor et al. | 206/412 |
| 2,427,318 | 9/1947 | Warren | 206/315.1 |
| 3,504,915 | 4/1970 | Walker | 206/315.1 X |
| 3,704,892 | 12/1972 | Moravick et al. | 206/315.1 X |
| 4,505,424 | 3/1985 | Chappars | 206/412 X |
| 5,105,944 | 4/1992 | Ingalls et al. | 206/412 |

*Primary Examiner*—Jacob K. Ackun, Jr.
*Attorney, Agent, or Firm*—Swabey Ogilvy Renault

[57] ABSTRACT

A cloth material such as a felt on which there is a rectangular outline is provided and the puzzle is partly or completely assembled inside the outline. When it is intended to store away the puzzle, the felt with the puzzle is rolled over a tube which is normally that which originally contained the felt. Once rolling is terminated, the felt is secured with straps and the whole is stored in a choice location.

21 Claims, 2 Drawing Sheets

METHOD AND DEVICE FOR STORING A PUZZLE

BACKGROUND OF INVENTION (a) Field of the Invention

This invention relates to a method and a device for storing a partially or completely assembled puzzle. More particularly, the present invention is concerned with a method and a device which enables a person to store away a partially or completely assembled puzzle without having to take it apart when the surface over which it was assembled is needed.

(b) Description

Making puzzles is a pastime which has been popular for a very long time and continues to be the main hobby of a certain number of people, especially older persons who are retired. With the advent of complicated puzzles numbering more than about 500 pieces, making a puzzle can take a few days, which means that the surface on which the pieces of the puzzle are assembled is not readily available for other chores.

There is therefore a need for enabling a person to store away a partially or completely assembled puzzle so as to free the surface on which the puzzle was assembled.

SUMMARY OF THE INVENTION

The invention provides a method for storing a puzzle, which comprises providing a cloth material and spreading it over a flat surface, the cloth material having some surface roughness and comprising an outline formed thereon, assembling at least some pieces of the puzzle inside the outline, placing a roller at one end of the cloth material and rolling the cloth material containing assembled pieces of the puzzle until the cloth material and the pieces of the puzzle are entirely rolled over the roller, whereby the at least partly assembled puzzle can be stored in a choice location.

The cloth material which is rolled over the roller is preferably secured around the roller before being stored away.

In accordance with a preferred embodiment of the invention, the cloth material is a fabric, preferably a piece of felt. The piece of felt is usually rectangular and the outline is then also rectangular.

In accordance with another preferred embodiment, the rectangular outline is formed so as to leave a larger free at one end of the piece of felt than at the other end thereof. The method then involves rolling the piece of felt starting at the end with the larger free area.

In accordance with yet another preferred embodiment, the roller consists of a tubular member which can also serve to store the piece of felt when the latter is not in use, the tubular member also including end covers to close both ends thereof.

Preferably, the tubular member has a diameter which varies between about 8 and 12 cm, most preferably about 10 cm.

In accordance with yet another preferred embodiment, the cloth material is secured around said tubular member by means of straps, and preferably the rolled felt is secured near both ends of the tubular member and at the center thereof by means of three straps.

The invention also provides a device for storing a puzzle, which comprises a piece of cloth material having some surface roughness and an outline formed thereon, a roller enabling to roll thereover the piece of cloth material containing assembled pieces of puzzle, and means for securing the rolled piece of cloth material over the roller.

BRIEF DESCRIPTION OF DRAWINGS

The invention is exemplified by means of the following drawings which are given only for the purpose of illustration and without limitation, in which.

DESCRIPTION OF PREFERRED EMBODIMENTS

Figure 1:
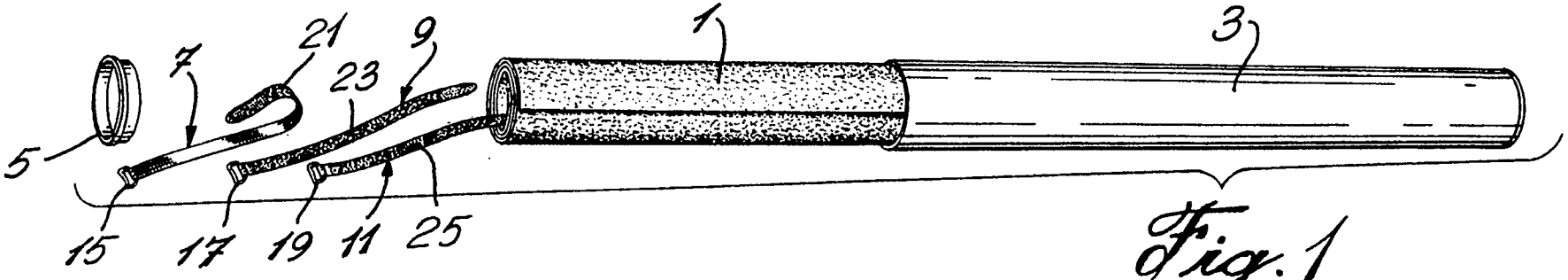
FIG. 1 is a perspective view of a device according to the invention while being unpacked.
Figure 2:
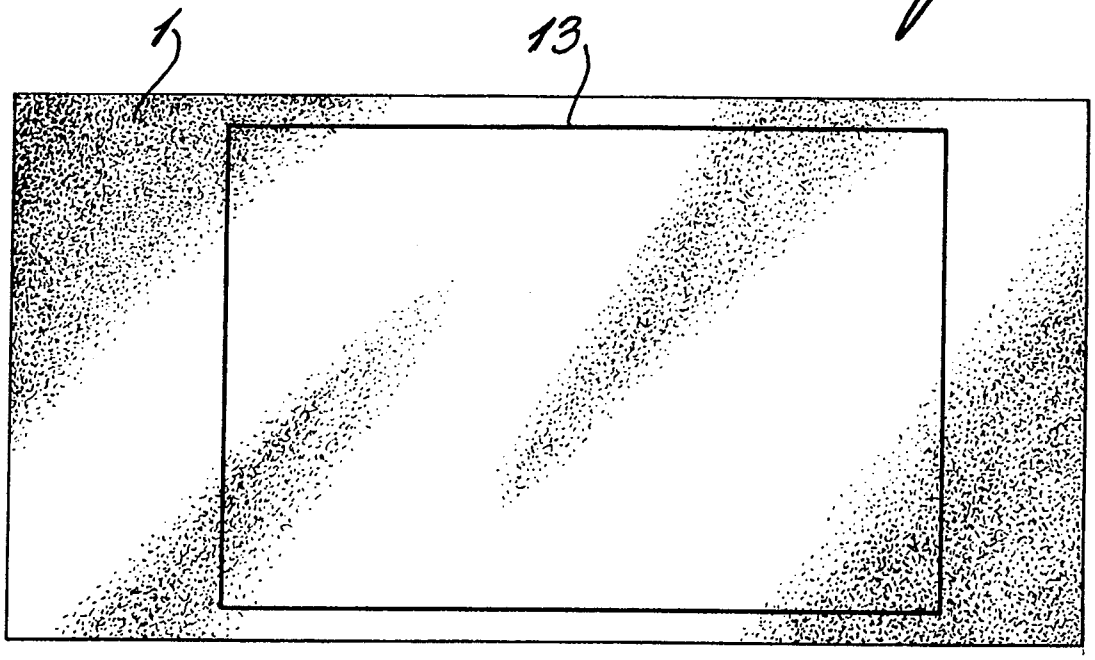
FIG. 2 shows a felt carpet with one rectangular outline thereon inside of which a puzzle is intended to be assembled.
Figure 4:
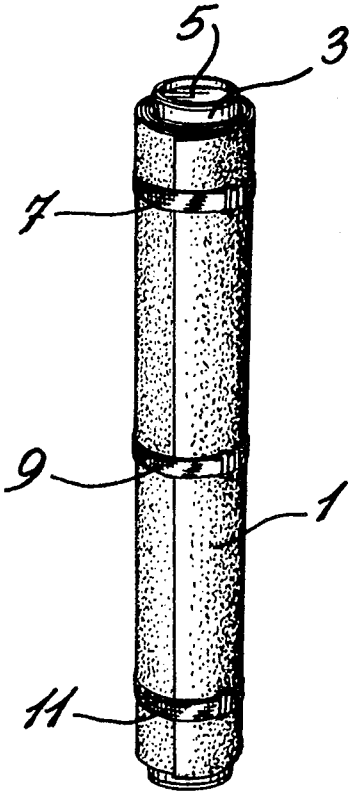
FIG. 4 is a perspective view of the stored away puzzle.

With reference to the drawings, it will be seen that the device which is illustrated consists of a felt carpet 1, a tube 3, which can be closed at both ends thereof by means of plug covers 5, and straps 7, 9, 11.

The felt carpet 1 is rectangular, as shown, and is made of a felt material which has just sufficient surface roughness to prevent a piece of puzzle to easily slide thereover. A preferred felt carpet has a thickness which as small as possible. The felt carpet 1 includes a rectangular outline 13, which is preferably of a different color than the felt material. For example, the carpet is normally green and the outline is preferably white.

In the embodiment which is illustrated, tube 3 is made of a tubular member of thick cardboard which is opened at both ends thereof. Plug covers 5 of standard construction are used to close both ends of the tubular cardboard member although this may vary, depending on needs and circumstances. Finally, straps 7, 9, 11 are identical and in the illustrated embodiment, they each consist of a plastic strip having a buckle 15, 17, 19 at one end thereof and one VELCRO ® face 21, 23, 25.

Figure 3:
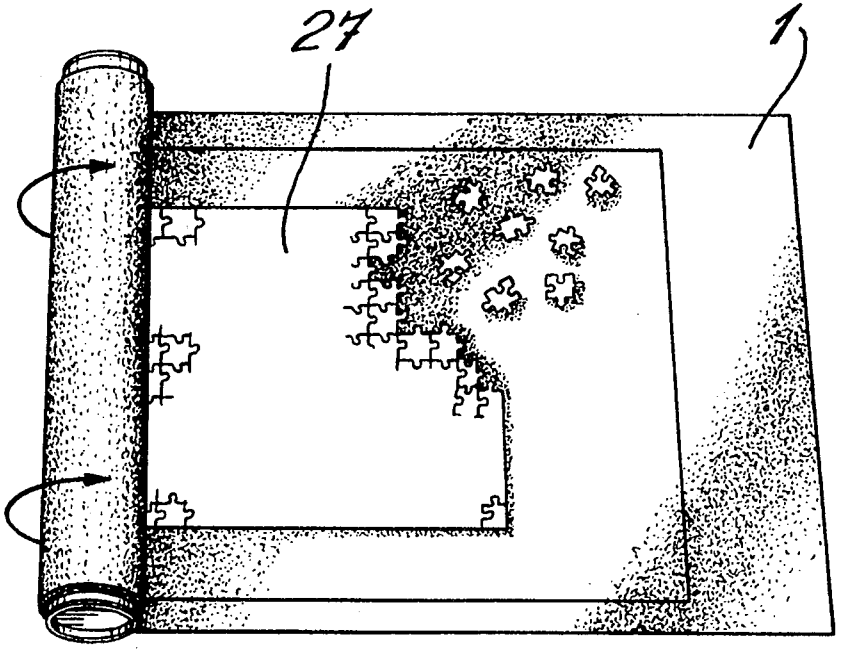
FIG. 3 shows a puzzle partially assembled on a felt carpet according to the invention, in the process of being rolled over a tubular member.

Use of the device according to the invention is as follows. After a puzzle 27 has been partially (or completely) assembled on felt carpet 1, as shown in FIG. 3, the tubular member 3 is placed outside the outline 13 at the end of the felt carpet 1 having the larger area. Care is taken so that the pieces of puzzle do not overlap. Carpet 1 is then tightly rolled over tubular member 3 (as shown in FIG. 3) until the entire carpet is rolled. The ends of the rolled felt carpet 1 are then fastened with straps 7 and 9 and the carpet is finally secured using center strap 11. The straps are then pulled gently through their respective buckles 15, 17 and 19 and the ends are engaged against VELCRO ® faces 21, 23 and 25.

The puzzle which is partially or completely assembled can then be stored in a choice location.

Of course, modifications which will be obvious to anyone skilled in the art, are possible without departing from the scope and spirit according to the invention.

We claim:

1. Method for storing a puzzle, which comprises providing a piece of cloth material and spreading it over a flat surface, said cloth material having sufficient surface roughness to prevent a piece of puzzle to easily slide thereover and comprising an outline formed thereon, assembling at least some pieces of said puzzle inside said outline, placing a roller comprising a tubular member at one end of said cloth material and rolling said cloth material containing assembled pieces of said puzzle until said cloth material and said pieces of said puzzle are entirely rolled over said roller, securing said rolled cloth material over said roller with at least one strap, whereby the at least partly assembled puzzle can be stored in a choice location.

2. Method according to claim 1, wherein the cloth material which is rolled over said roller is secured around said roller before being stored away.

3. Method according to claim 2, wherein said cloth material is a fabric.

4. Method according to claim 3, wherein said fabric is a piece of felt.

5. Method according to claim 4, wherein said piece of felt is rectangular and said outline is also rectangular.

6. Method according to claim 5, wherein said rectangular outline is formed on said piece of felt in a manner so as to leave a larger free area at one end of said piece of felt than at the other end thereof, and rolling said piece of felt starting at said end with the larger free area.

7. Method according to claim 6, wherein said roller comprises said tubular member which can also serve to store the piece of felt when the latter is not in use, said tubular member also including end covers to close both ends thereof.

8. Method according to claim 7, wherein said tubular member has a diameter which varies between about 8 and 12 cm.

9. Method according to claim 8, wherein said tubular member has a diameter which is about 10 cm.

10. Method according to claim 9, which comprises securing said cloth material around said tubular member by means of a plurality of straps.

11. Method according to claim 10, which comprises securing said rolled felt near both ends of said tubular member and at the center thereof by means of three said straps.

12. Device for storing a puzzle, which comprises a generally rectangular piece of cloth material having sufficient surface roughness to prevent a piece of puzzle from easily sliding thereover, an outline formed thereon, and assembled pieces of a puzzle formed on the cloth material within the outline, a roller comprising a tubular member on which said piece of cloth material containing said assembled pieces of said puzzle is removably rolled, and at least one strap for securing said rolled piece of cloth material over said roller.

13. Device according to claim 12, wherein said cloth material is a fabric.

14. Device according to claim 13, wherein said fabric is a piece of felt.

15. Device according to claim 14, wherein said piece of felt is rectangular and said outline is also rectangular.

16. Device according to claim 15, wherein said rectangular outline is formed on said piece of felt so as to leave a larger free area at one end of said piece of felt than at the other end thereof.

17. Device according to claim 16, wherein said roller comprises said tubular member which can also serve to store the piece of felt when the latter is not in use, said tubular member also including end covers to close both ends thereof.

18. Device according to claim 17, wherein said tubular member has a diameter which varies between about 8 and 12 cm.

19. Device according to claim 18, wherein said tubular member has a diameter which is about 10 cm.

20. Device according to claim 19, which comprises a plurality of straps for securing said cloth material around said tubular member.

21. Device according to claim 20, which comprises two straps for securing said felt material at both ends of said tubular member and an additional strap for securing said felt material at the center of said roller.

* * * * *